United States Patent [19]

Ishikawa et al.

[11] 4,341,190

[45] Jul. 27, 1982

[54] AIR-FUEL RATIO CONTROL DEVICE OF AN INTERNAL COMBUSTION ENGINE

[75] Inventors: Norikatsu Ishikawa, Mishima; Haruyuki Obata, Susono; Hidemi Onaka, Susono; Takao Tate, Susono; Toshio Tanahashi, Susono; Isamu Hagino, Aichi, all of Japan

[73] Assignee: Toyota Jidosha Kogyo Kabushiki Kaisha, Toyota, Japan

[21] Appl. No.: 237,949

[22] Filed: Feb. 25, 1981

[30] Foreign Application Priority Data

| | | | |
|---|---|---|---|
| May 14, 1980 | [JP] | Japan | 55-62703 |
| May 14, 1980 | [JP] | Japan | 55-62704 |
| May 14, 1980 | [JP] | Japan | 55-62705 |
| May 14, 1980 | [JP] | Japan | 55-62706 |

[51] Int. Cl.[3] ..... F02M 7/18

[52] U.S. Cl. ..... 123/439; 123/440

[58] Field of Search ..... 123/439, 440, 489

[56] References Cited

U.S. PATENT DOCUMENTS

| | | | |
|---|---|---|---|
| 4,109,615 | 8/1978 | Asano | 123/440 |
| 4,132,193 | 1/1979 | Takase et al. | 123/440 |
| 4,155,335 | 5/1979 | Hosaka et al. | 123/440 |
| 4,248,196 | 2/1981 | Toelle | 123/440 X |
| 4,278,060 | 7/1981 | Isobe et al. | 123/440 |

*Primary Examiner*—Tony M. Argenbright

*Attorney, Agent, or Firm*—Cushman, Darby & Cushman

[57] ABSTRACT

An air-fuel ratio control device of an internal combustion engine having a carburetor. An air bleed passage is connected to a fuel outflow passage of the carburetor, and an electromagnetic control valve is arranged in the air bleed passage. The control valve is controlled by the detecting signal of an oxygen concentration detector arranged in the exhaust passage so that the air-fuel ratio of a mixture fed into the cylinder of an engine becomes equal to the stoichiometric air-fuel ratio. After the completion of the warm-up of an engine, the opening area of the control valve is maintained within a fixed range. Before the completion of the warm-up of an engine, the opening degree of the control valve becomes larger than the above-mentioned fixed range.

39 Claims, 18 Drawing Figures

$V_B$
44
76
69
75
70
68
73
74
67
190
188
66
198
194
187
64
193
192
191
189
196
195
63
65
106
105
107
104
121
109
71
72
110
62
78
77
79
103
61
101
108
102
8
176
197
85

AIR-FUEL RATIO CONTROL DEVICE OF AN INTERNAL COMBUSTION ENGINE

DESCRIPTION OF THE INVENTION

The present invention relates to an air-fuel ratio control device of an internal combustion engine.

As a method of simultaneously reducing an amount of harmful HC, CO and $NO_x$ components in the exhaust gas, a method has been known, in which a three way catalytic converter is arranged in the exhaust passage of an engine. The purifying efficiency of the three way catalyzer becomes maximum when the air-fuel ratio of the mixture fed into the cylinder of an engine becomes equal to the stoichiometric air-fuel ratio. Consequently, in the case wherein a three way catalytic converter is used for purifying the exhaust gas, it is necessary to equalize the air-fuel ratio of the mixture fed into the cylinder to the stoichiometric air-fuel ratio. As an air-fuel ratio control device capable of equalizing the air-fuel ratio of the mixture fed into the cylinder of an engine to the stoichiometric air-fuel ratio, an air-fuel ratio control device has been known in which an oxygen concentration detector is arranged in the exhaust passage located upstream of the three way catalytic converter, and a carburetor has an air bleed passage connected to a fuel outflow passage of the carburetor. The amount of air fed into the fuel outflow passage from the air bleed passage is controlled on the basis of the output signal of the oxygen concentration detector, so that the air-fuel ratio of the mixture formed in the carburetor becomes equal to the stoichiometric air-fuel ratio. In an engine equipped with such an air-fuel ratio control device, an easy starting of the engine is ensured in such a way that a rich mixture is fed into the cylinder of the engine at the time of starting the engine by reducing the amount of air fed into the fuel outflow passage of the engine. However, in such an engine, since an extremely rich mixture is fed into the cylinder of the engine even after the engine begins to rotate by its own power, a problem occurs in that a large amount of harmful HC and CO components is discharged into the exhaust passage from the cylinder of the engine.

An object of the present invention is to provide an internal combustion engine capable of preventing a mixture fed into the cylinder of an engine from becoming rich after the engine begins to rotate by its own power.

Another object of the present invention is to provide an internal combustion engine capable of preventing a mixture fed into the cylinder of an engine from becoming rich before the completion of warm-up of the engine in the case wherein the engine is operated at a high altitude.

According to the present invention, there is provided an air-fuel ratio control device of an internal combustion engine having at least one cylinder, an intake passage and an exhaust passage, said device comprising: a carburetor arranged in the intake passage and having a choke apparatus for reducing an air-fuel ratio of a mixture fed into the cylinder from said carburetor when the engine is started, said carburetor having a fuel reservoir and a fuel outflow passage which interconnects said reservoir to said intake passage; an air bleed passage interconnecitng said fuel outflow passage to the atmosphere for feeding air into said fuel outflow passage; a temperature reactive switch for detecting the temperature of the engine to produce a detecting signal indicating whether the temperature of the engine is lower or higher than a first predetermined temperature; an air-fuel ratio detector arranged in the exhaust passage and detecting components of an exhaust gas in the exhaust passage for producing a detecting signal which has a potential level which becomes high or low when the air-fuel ratio of said mixture becomes less or larger than the stoichiometric air-fuel ratio, respectively; a detecting signal processing circuit having a first comparator for comparing the level of the detecting signal of said air-fuel ratio detector with a reference voltage to produce an output voltage, said processing circuit having an integrating circuit for integrating the output voltage of said first comparator to produce a first control signal having a level which varies within a fixed range of voltage and becomes large as the air-fuel ratio of said mixture becomes small; control voltage generating means for generating a second control signal having a first level which is larger than said fixed range of voltage; switching means in response to the detecting signal of said temperature reactive switch for selectively producing an output voltage which is equal to the level of said first control signal or the level of said second control signal when the temperature of the engine is higher or lower than said first predetermined temperature, respectively; a drive pulse generator for generating continuous drive pulses, each having a width which is proportional to the output voltage of said switching means, and; control valve means arranged in said air bleed passage and actuated in response to said drive pulses for increasing a flow area of said air bleed passage in accordance with an increase in the width of said drive pulse.

The present invention may be more fully understood from the description of preferred embodiments of the invention set forth below, together with the accompanying drawings.

DESCRIPTION OF PREFERRED EMBODIMENTS

Figure 1:
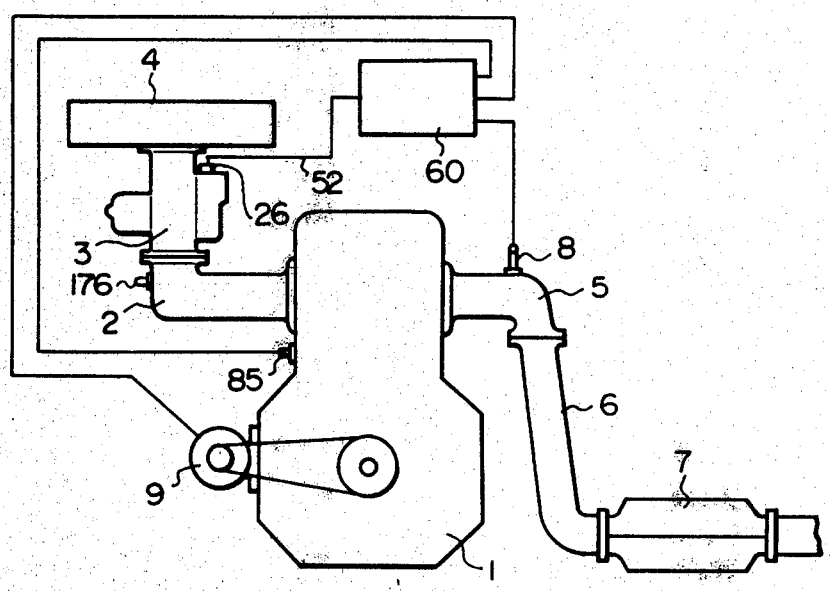
FIG. 1 is a front view of an internal combustion engine.
Figure 2:
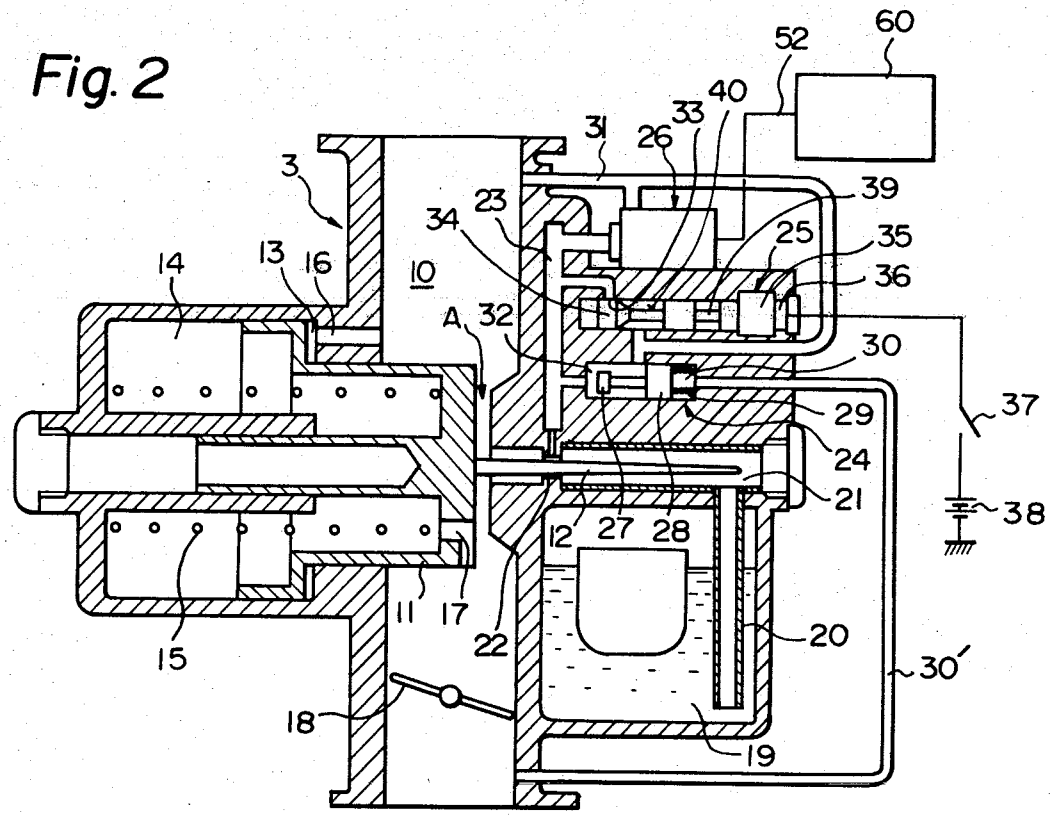
FIG. 2 is a cross-sectional side view of an embodiment of a carburetor according to the present invention.

Referring to FIG. 1, 1 designates an engine body, 2 an intake manifold, 3 a carburetor mounted on the intake manifold and 4 designates an air cleaner; 5 designates an exhaust manifold, 6 an exhaust pipe, 7 a three way catalytic converter, 8 an oxygen concentration detector arranged in the exhaust manifold 2 and 9 an alternator driven by the engine. Referring to FIG. 2, it will be understood that the carburetor 3 is a carburetor of a variable venturi and downdraft type, which has no choke valve. The carburetor 3 comprises a suction piston 11 transversely movable within an air horn 10, a metering needle 12 fixed onto the tip face of the suction piston 11, an atmospheric pressure chamber 13, a vacuum chamber 14 and a compression spring 15 for urging the suction piston 11 towards the atmospheric pressure chamber 13. A venturi A is formed between the tip face of the suction piston 11 and the inner wall of the air horn 10. The atmospheric pressure chamber 13 is connected via an air hole 16 to the air horn 10 located upstream of the venturi A, and the vacuum chamber 14 is connected via a vacuum hole 17 to the air horn 10 located downstream of the venturi A. In addition, a throttle valve 18 is arranged in the air horn 10 located downstream of the venturi A. As is known to these skilled in the art, the suction piston 11 moves towards the left or the right in FIG. 2, so that the pressure difference between a pressure within the atmospheric pressure chamber 13 and a vacuum within the vacuum chamber 14 becomes equal to an approximately constant spring force of the compression spring 15.

In addition, the carburetor 3 comprises a float chamber 19 and a fuel passage 21 connected to the float chamber 19 via a fuel pipe 20. The metering needle 12 enters into the fuel passage 21. A metering jet 22 is arranged in the fuel passage 21, and fuel within the float chamber 19 is fed into the air horn 10 via an annular gap formed between the metering jet 22 and the metering needle 12. An air bleed passage 23 is formed in the carburetor 3. This air bleed passage 23 is connected, on one hand, to the metering jet 22 and, on the otherhand, to the air horn 10 via a power valve 24, a choke valve 25 and an electromagnetic control valve 26 which are arranged in parallel. The power valve 24 comprises a piston 28 having a valve body 27, and a compression spring 29 arranged in the vacuum chamber 30. This vacuum chamber 30 is connected via a vacuum conduit 30' to the air horn 10 located downstream of the throttle valve 18. When the level of vacuum, produced in the air horn 10 located downstream of the throttle valve 18, is as great as in the case wherein an engine is operating under a partial load, the piston 28 moves towards the right in FIG. 2 against the spring force of the compression spring 29, as illustrated in FIG. 2. At this time, air within the air horn 10 is fed into the metering jet 22 via an air bleed conduit 31 and an air bleed chamber 32 of the power valve 24, and via the air bleed passage 23. On the other hand, when the engine is operating under a heavy load, since the level of vacuum, produced in the air horn 10 located downstream of the throttle valve 18, becomes small, the piston 28 moves towards the left in FIG. 2 and shuts off the air stream flowing in the air bleed chamber 32. Consequently, when the engine is operating under a heavy load, the amount of air, fed into the metering jet 22 from the air bleed passage 23, is reduced and, as a result, an air-fuel ratio of the mixture formed in the carburetor 3 becomes small.

The choke valve 25 comprises a valve body 34 for controlling the opening area of an air bleed port 33, a wax valve 35 for actuating the valve body 34, and a Positive Temperature Coefficient Thermister (hereinafter referred to as a PTC) element 36 for heating the wax valve 35. The PTC element 36 is connected to a power source 38 via an ignition switch 37. As illustrated in FIG. 2, before an engine is started, the valve body 34 closes the air bleed port 33 and, therefore, the air stream passing through the choke valve 25 is shut off. When the ignition switch 37 is turned to the ON condition, since the PTC element 36 issues heat, a rod 39 of the wax valve 35 gradually projects and, thereby, the valve body 34 moves towards the left in FIG. 2. As a result of this, the air bleed port 33 is gradually opened and, thus, air within the air horn 10 is fed into the metering jet 22 via the air bleed conduit 31, an air bleed chamber 40 and the air bleed passage 23. Consequently, the air bleeding operation of the choke valve 25 is started a little while after the ignition switch 37 is turned to the ON condition. Then, since the amount of air, fed into the metering jet 22 via the choke valve 18, is gradually increased, an air-fuel ratio of the mixture formed in the carburetor 3 becomes gradually large.

Figure 3:
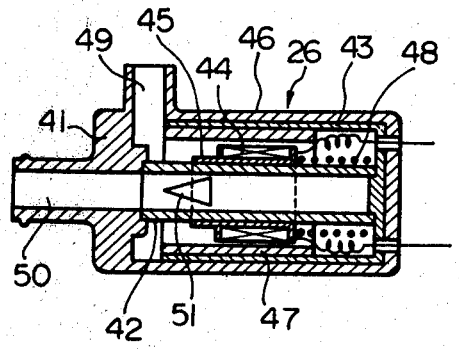
FIG. 3 is an enlarged cross-sectional side view of an electromagnetic control valve.

As illustrated in FIG. 3, the electromagnetic control valve 26 comprises a pair of hollow cylindrical stators 42, 43 made of ferromagnetic material and arranged in a housing 41, a sliding sleeve 45 slidably inserted onto the stator 42 and supporting a coil 44 thereon, cylindrical split permanent magnets 46, 47 fixed onto the inner wall of the stator 43, and a compression spring 48 for urging the sliding sleeve 45 towards the left in FIG. 3. In addition, an air inlet 49, formed in the housing 41, is connected to the air horn 10 via the air bleed conduit 31 (FIG. 2) and an air outlet 50, formed in the housing 41, is connected to the air bleed passage 23. A triangular shaped opening 51 is formed on the stator 42, and the air inlet 49 and the air outlet 50 are interconnected to each other via the opening 51. The cylindrical permanent magnets 46, 47 are so formed that, for example, the polarity of the insides thereof is "N" and the polarity of the outsides thereof is "S". Consequently, a radial field is formed within the cylindrical permanent magnets 46, 47. The coil 44 is wound so that, when an electric current flows in the coil 44, the coil 44 is subjected to a force causing the coil 44 to move towards the right in FIG. 3. The above-mentioned force is strengthened as the amount of electric current fed into the coil 44 is increased. Therefore, the sliding sleeve 45 moves towards the right in FIG. 3 against the spring force of the compression spring 48 as the amount of electric current fed into the coil 44 is increased. Thus, it will be understood that the electromagnetic control valve 26 forms a linear motor. As illustrated in FIG. 3, the opening area of the triangular shaped opening 51 is increased as the sliding sleeve 45 moves towards the right in FIG. 3. Therefore, the amount of air, passing through the electromagnetic control valve 26, is increased as the amount of electric current fed into the coil 44 is increased. When an electric current is not fed into the coil 44, the sliding sleeve 45 completely closes the triangular shaped opening 51 and, therefore, at this time the air stream passing through the electromagnetic control valve 26 is completely shut off. As illustrated in FIGS. 1 and 2, the coil 44 (FIG. 3) of the electromagnetic control valve 26 is connected to an electronic control circuit 60 via a lead 52.

Figure 5:
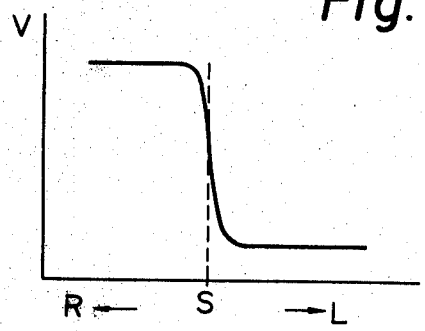
FIG. 5 is a graph illustrating a change in output voltage of an oxygen concentration detector.
Figure 4:
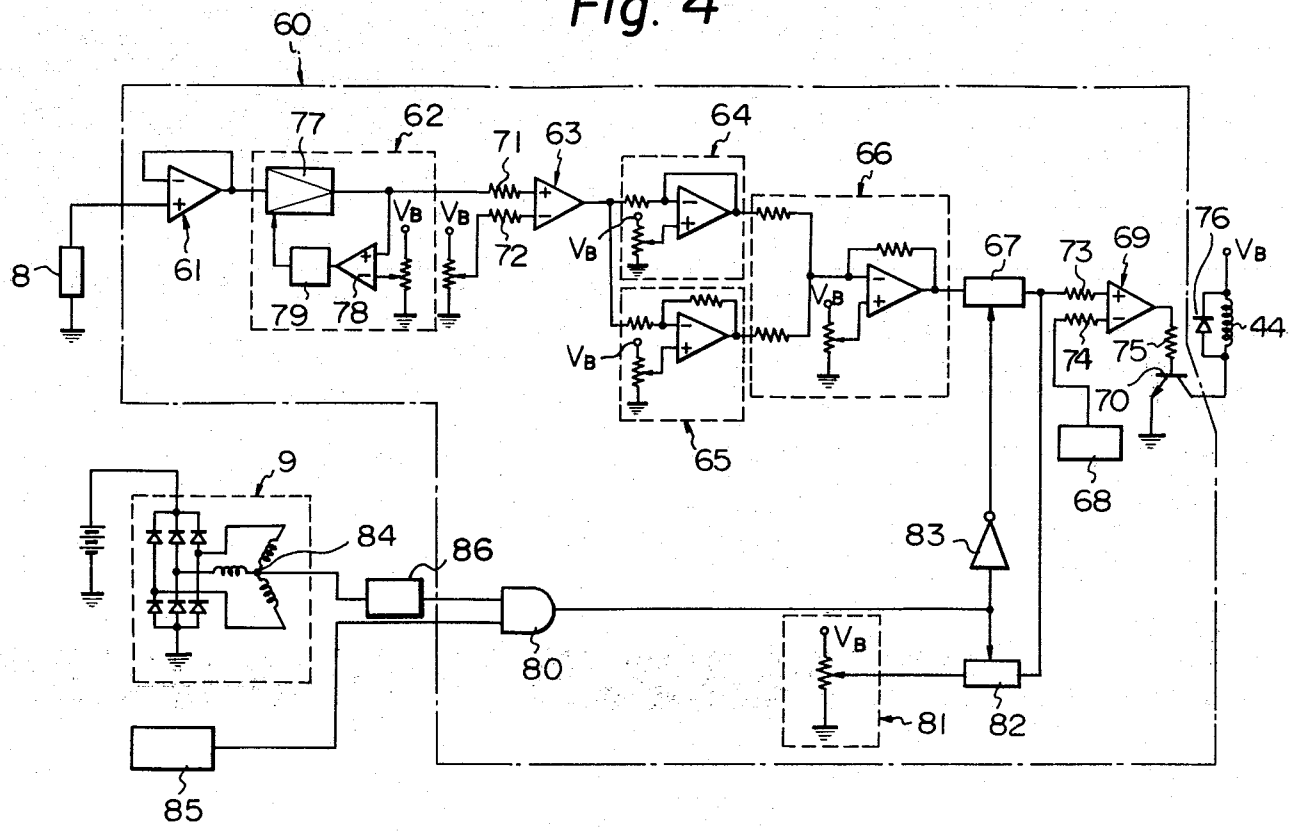
FIG. 4 is a circuit diagram of an embodiment of an electronic control circuit according to the present invention.

FIG. 4 illustrates a circuit diagram of the electronic control circuit 60. In FIG. 4, $V_B$ indicates a power supply voltage. Referring to FIG. 4, the oxygen concentration detector 8 illustrated in FIG. 1, is illustrated by a block 8. As illustrated in FIG. 5, the oxygen concentration detector 8 produces an output voltage of about 0.1 volt when the exhaust gas is an oxidizing atmosphere, that is, when an air-fuel ratio of the mixture fed into the cylinder of an engine is larger than the stoichiometric air-fuel ratio. On the other hand, the oxygen concentration detector 8 produces an output voltage of 0.9 volt when the exhaust gas is a reducing atmosphere, that is, when an air-fuel ratio of the mixture fed into the cylinder of an engine is less than the stoichiometric air-fuel ratio. In FIG. 5, the ordinate V indicates an output voltage of the oxygen concentration detector 8, and the abscissa indicates an air-fuel ratio of the mixture fed into the cylinder of an engine. In addition, in the abscissa, S indicates the stoichiometric air-fuel ratio, and L and R indicate the lean side and the rich side of the stoichiometric air-fuel ratio, respectively.

Turning to FIG. 4, the electronic control device 60 comprises a voltage follower 61, an AGC circuit 62, a first comparator 63, an integrating circuit 64, a proportional circuit 65, an adder circuit 66, a first analog switch 67, a saw tooth shaped wave generating circuit 68, a second comparator 69 and a transistor 70. The output terminal of the oxygen concentration detector 8 is connected to the non-inverting input terminal of the voltage follower 61 and the output terminal of the voltage follower 61 is connected to the input terminal of the AGC circuit 62. The output terminal of the AGC circuit 62 is connected to the non-inverting input terminal of the first comparator 63 via a resistor 71 and a reference voltage of about 0.4 volt is applied to the inverting input terminal of the first comparator 63 via a resistor 72. The output terminal of the first comparator 63 is connected, on one hand, to the input terminal of the integrating circuit 64 and, on the other hand, to the input terminal of the proportional circuit 65. The output terminal of the integrating circuit 64 is connected to a first input terminal of the adder circuit 66 and the output terminal of the proportional circuit 65 is connected to a second input terminal of the adder circuit 66. The output terminal of the adder circuit 66 is connected to the non-inverting input terminal of the second comparator 69 via the first analog switch 67 and a resistor 73, and the inverting input terminal of the second comparator 69 is connected to the saw tooth shaped wave generating circuit 68 via a resistor 74. The output terminal of the second comparator 69 is connected to the base of the transistor 70 via a resistor 75. The emitter of the transistor 70 is grounded and the collector of the transistor 70 is connected to the coil 44 of the electromagnetic control valve 26 (FIG. 3). In addition, a diode 76 for absorbing surge current is connected, in parallel, to the coil 44.

Figure 6:
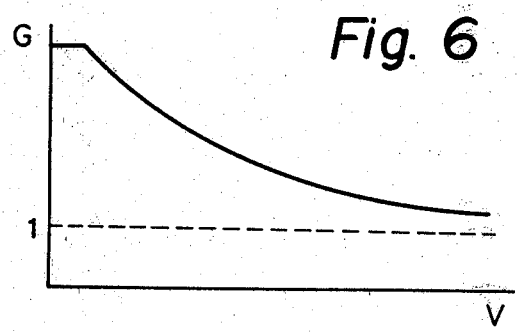
FIG. 6 is a graph illustrating a change in gain of an AGC circuit.
Figure 7:
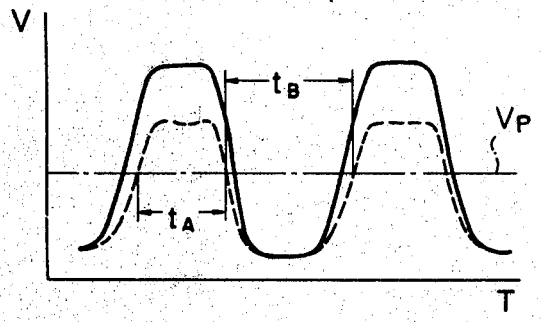
FIG. 7 is a graph illustrating a change in output voltage of an AGC circuit.

The AGC circuit 62 comprises a variable gain amplifier 77, a comparator 78 and an integrating circuit 79. The non-inverting input terminal of the comparator 78 is connected to the output terminal of the variable gain amplifier 77 and a fixed voltage is applied to the inverting terminal of the comparator 78. The output terminal of the comparator 78 is connected to the input terminal of the integrating circuit 79, and the gain of the variable gain amplifier 77 is controlled by the output voltage of the integrating circuit 79, as illustrated in FIG. 6. In FIG. 6, the ordinate G indicates gain of the variable gain amplifier 77 and the abscissa V indicates output voltage of the integrating circuit 79. When the temperature of the oxygen concentration detector 8 is less than, for example, 400° C., the oxygen concentration detector 8 does not produce an output voltage. On the other hand, when the temperature of the oxygen concentration detector 8 is increased beyond, for example, 400° C., the oxygen concentration detector 8 produces an output voltage, as illustrated in FIG. 5. When the oxygen concentration detector 8 produces an output voltage as illustrated in FIG. 5 and, thus, the feedback controlling operation of the electric control circuit 60 is started, the output voltage of the oxygen concentration detector 8 alternately repeats high level and low level. The output signal of the oxygen concentration detector 8 is fed into the AGC circuit 62 via the voltage follower 61 and, as a result, a voltage, illustrated by the solid line in FIG. 7, is produced at the output terminal of the variable gain amplifier 77. In FIG. 7, the ordinate V indicates output voltage of the variable gain amplifier 77 and the abscissa T indicates time. In addition, in FIG. 7, $V_p$ indicates a fixed voltage applied to the inverting input terminal of the comparator 78. If the output voltage of the oxygen concentration detector 8 is reduced and, thereby, the output voltage of the variable gain amplifier 77 is reduced as illustrated by the broken line in FIG. 7, the length of time $t_B$, during which the output voltage of the comparator 78 becomes high level, becomes longer than the length of time $t_A$, during which the output voltage of the comparator 78 becomes low level. The integrating circuit 79 is so constructed that the output voltage thereof is reduced as the ratio of $t_B/t_A$ is increased. From FIG. 6, it will be understood that the gain of the variable gain amplifier 77 is increased as the ratio $t_B/t_A$ is increased. Therefore, the peak of the output voltage of the variable gain amplifier 77 is pulled up from the voltage, illustrated by the broken line in FIG. 7, to the voltage illustrated by the solid line in FIG. 7. Consequently, the peak of the output voltage produced at the output terminal of the AGC circuit 62 is maintained constant, independently of the level of the peak of the output voltage of the oxygen concentration detector 8.

Figure 8:
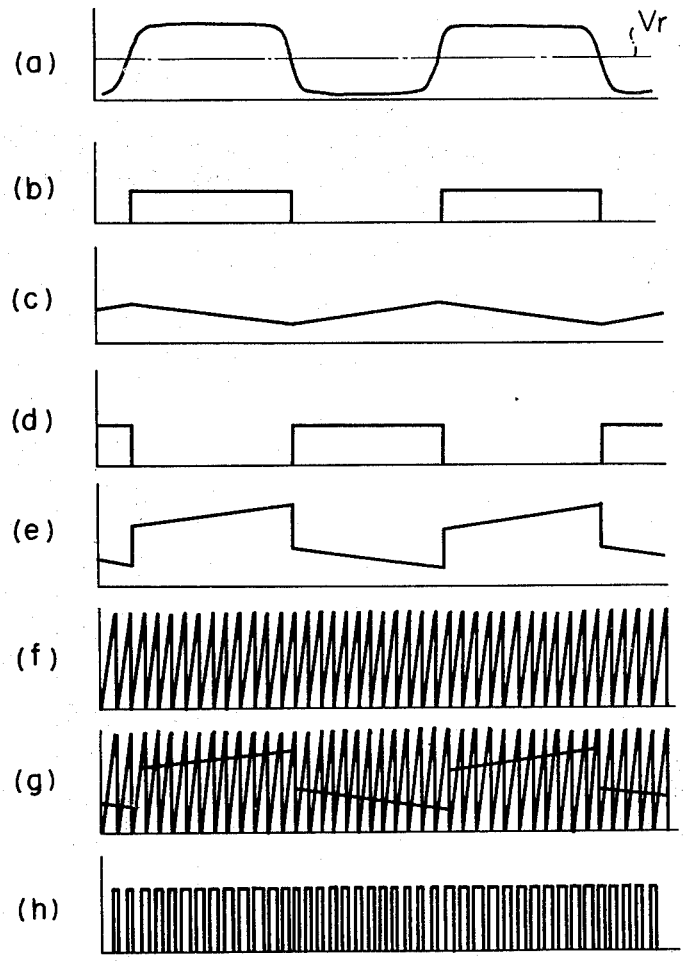
FIG. 8 is a time chart illustrating a change in voltage in an electronic control circuit.

FIG. 8(*a*) illustrates the output voltage of the AGC circuit 62 illustrated in FIG. 4. In addition, in FIG. 8(*a*), $V_r$ indicates the reference voltage applied to the inverting input terminal of the first comparator 63. The output voltage of the first comparator 63 becomes high level when the output voltage of the AGC circuit 62 is increased beyond the reference voltage $V_r$. Thus, the first comparator 63 produces an output voltage as illustrated in FIG. 8(*b*). The output voltage of the first comparator 63 is integrated in the integrating circuit 64 and, as a result, the integrating circuit 64 produces an output voltage as illustrated in FIG. 8(*c*). On the other hand, the output voltage of the first comparator 63 is amplified in the proportional circuit 65 and, thus, the proportional circuit 65 produces an output voltage as illustrated in FIG. 8(*d*). The output voltage of the integrating circuit 64 and the output voltage of the proportional circuit 65 are added in the adder circuit 66 and, thus, the adder circuit 66 produces an output voltage as illustrated in FIG. 8(*e*). On the other hand, the saw tooth shaped wave generating circuit 68 produces a saw tooth shaped output voltage of a fixed frequency as illustrated in FIG. 8(*f*). If the first analog switch 67 is in the conductive state, the output voltage of the adder circuit 66 and the output voltage of the saw tooth shaped wave generating circuit 68 are compared in the second comparator 69 as illustrated in FIG. 8(*g*). The output voltage of the second comparator 69 becomes high level when the output voltage of the adder circuit 66 becomes larger than that of the saw tooth shaped wave generating circuit 68. Consequently, the second comparator 69 produces continuous pulses, as illustrated in FIG. 8(*h*), and the widths of the continuous pulses are proportional to the level of the output voltage of the adder circuit 66. An electric current fed into the coil 44 is controlled by the continuous pulses, so that the amount of electric current fed into the coil 44 is increased as the widths of the continuous pulses are increased. From FIG. 8, it will be understood that, when the output voltage of the AGC circuit 62 becomes high level, that is, when the air-fuel ratio of mixture fed into the cylinder of an engine becomes smaller than the stoichiometric air-fuel ratio, the widths of the continuous pulses produced at the output terminal of the second comparator 69 are increased, and thereby, the amount of electric current fed into the coil 44 is increased. If the amount of electric current fed into the coil 44 is increased, the opening area of the triangle shaped opening 51 (FIG. 3) of the electromagnetic control valve 26 is increased, as mentioned previously. As a result of this, in FIG. 2, since the amount of air, fed into the metering jet 22 from the air horn 10 via the electromagnetic control valve 26, is increased, an air-fuel ratio of the mixture, fed into the cylinder of an engine, becomes large. After this, when an air-fuel ratio of the mixture fed into the cylinder of an engine becomes larger than the stoichiometric air-fuel ratio, the output voltage of the AGC circuit 62 (FIG. 4) becomes low level. As a result of this, since the amount of electric current fed into the coil 44 is reduced, and thereby, the amount of air fed into the metering jet 22 via the electromagnetic valve 26 is reduced, an air-fuel ratio of the mixture fed into the cylinder of an engine becomes small. After this, when an air-fuel ratio of the mixture fed into the cylinder of an engine becomes smaller than the stoichiometric air-fuel ratio, the output voltage of the AGC circuit 62 (FIG. 4) becomes high level. As a result of this, since the amount of air fed into the metering jet 22 via the electromagnetic control valve 26 is increased, an air-fuel ratio of the mixture fed into the cylinder of an engine becomes large again. Thus, an air-fuel ratio of the mixture fed into the cylinder of an engine becomes equal to the stoichiometric air-fuel ratio.

Referring to FIG. 4, the electronic control circuit 60 comprises an AND gate 80 and a function generator 81. The output terminal of the function generator 81 is connected via a second analog switch 82 to the connecting point of the first analog switch 67 and the resistor 73. The first analog switch 67 is controlled by the output voltage of the AND gate 80 via an inverter 83 and the second analog switch 82 is directly controlled by the output voltage of the AND gate 80. One of input terminals of the AND gate 80 is connected to the neutral point 84 of the alternator 9 via a recifying circuit 86 and the other input terminal of the AND gate 80 is connected to a temperature reactive switch 85. The temperature reactive switch 85 is in the ON condition when temperature of the cooling water of an engine is lower than about 60° C., while the temperature reactive switch 85 is turned to the OFF condition when the temperature of the cooling water of an engine is increased beyond 60° C. On the other hand, when an engine remains stopped or at the time of cranking wherein an engine is rotated by a starter motor, voltage is not produced at the neutral point 84 of the alternator 9. Contrary to this, when an engine begins to rotate by its own power, the voltage produced at the neutral point 84 of the alternator 9 is increased.

When an engine remains stopped and, thus, the temperature of the oxygen concentration detector 8 is low, the oxygen concentration detector 8 does not produce an output voltage, as mentioned previously. At this time, if the temperature of the cooling water of an engine is below 60° C., the temperature reactive switch 85 is in the ON condition, as mentioned previously. When an engine is rotated by a starter motor for starting an engine, voltage is not produced at the neutral point 84 of the alternator 9 during the time an engine is rotated by a starter motor. Consequently, at this time, since the output voltage of the AND gate 80 is low level, the first analog switch 67 is in the conductive state and the second analog switch 82 is in the non-conductive state. However, even if the first analog switch 67 is in the conductive state, since the oxygen concentration detector 8 does not produce an output voltage and, therefore, voltage is not produced at the output terminal of the adder circuit 66, an electric current is not fed into the coil 44. As a result of this, in FIG. 2, the electromganetic control valve 26 is completely closed. In addition, at this time, the choke valve 26 is completely closed and, since the level of vacuum produced in the air horn 10 located downstream of the throttle valve 18 is small, the power valve 24 is also completely closed. As a result of this, since the air bleeding operation is completely stopped, an extremely rich mixture is fed into the cylinder of an engine.

When an engine begins to rotate by its own power, in FIG. 4, since the voltage produced at the neutral point 84 of the alternator 9 is increased, the output voltage of the AND gate 80 is turned to the high level from the low level. As a result of this, the first analog switch 67 is turned to the non-conductive state from the conductive state and the second analog switch 82 is turned to the conductive state from the non-conductive state. Consequently, at this time, the output voltage of the function generator 81 is applied to the non-inverting input terminal of the second comparator 69 via the resistor 73.

Figure 9:
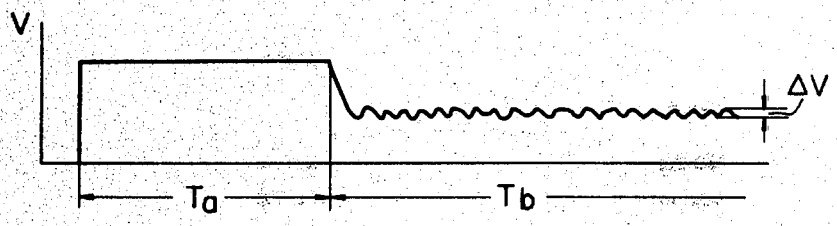
FIG. 9 is a time chart illustrating a change in voltage applied to the non-inverting input terminal of a second comparator.

FIG. 9 illustrates change in voltage applied to the non-inverting input terminal of the second comparator 69. In FIG. 9, the ordinate V indicates a voltage applied to the non-inverting input terminal of the second comparator 69 and the abscissa indicates time. In addition, in FIG. 9, $T_a$ indicates a time period during which the output voltage of the function generator 81 is applied to the non-inverting input terminal of the second comparator 69 and $T_b$ indicates a time period during which the output voltage of the adder circuit 66 is applied to the non-inverting input terminal of the second comparator 69. The output voltage of the adder circuit 66, which is illustrated in FIG. 8(*e*), is exaggeratedly depicted for the sake of illustration and, as indicated in the time period $T_b$ in FIG. 9, the actual fluctuation $\Delta V$ of the output voltage of the circuit 66 is rather small. From FIG. 9, it will be understood that the output voltage of the function generator 81, which is indicated within the time period $T_a$, is larger than the output voltage of the adder circuit 66, which is indicated within the time period $T_b$ and produced after the feedback controlling operation is started. Therefore, when an engine begins to rotate by its own power, since a high voltage, as indicated within the time period $T_a$ in FIG. 9, is applied to the non-inverting input terminal of the second comparator 69, the amount of electric current fed into the coil 44 is considerably increased. This results in the electromagnetic control valve 26 being fully opened.

In FIG. 2, when an engine begins to rotates by its own power, since a great vacuum is produced in the air horn 10 located downstream of the throttle valve 18, the power valve 24 is fully opened, but the choke valve 25 remains completely closed. At this time, even if the choke valve 25 is completely closed, since the electromagnetic control valve 26 is fully opened as mentioned above, a large amount of air is fed into the metering jet 22 via the power valve 24 and the electromagnetic control valve 25. As a result of this, the air-fuel ratio of the mixture fed into the cylinder of an engine becomes considerably large, as compared with that of the mixture fed into the cylinder of an engine when an engine is rotated by a starter motor, and therefore, it is possible to reduce the amount of harmful HC and CO components in the exhaust gas.

Turning to FIG. 4, as mentioned previously, when the temperature of the cooling water of an engine is increased beyond 60° C., the temperature reactive switch 85 is turned to the OFF condition. As a result of this, since the output voltage of the AND gate 80 becomes low level, the first analog switch 67 is turned again to the conductive state and, thus, as indicated within the time period $T_b$ in FIG. 9, the feedback controlling operation is started.

Figure 10:
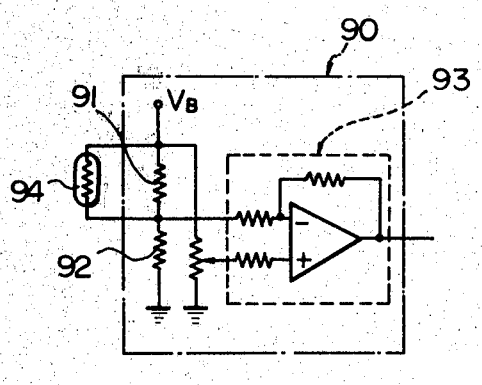
FIG. 10 is a circuit diagram of another embodiment of an electronic control circuit according to the present invention.
Figure 11:
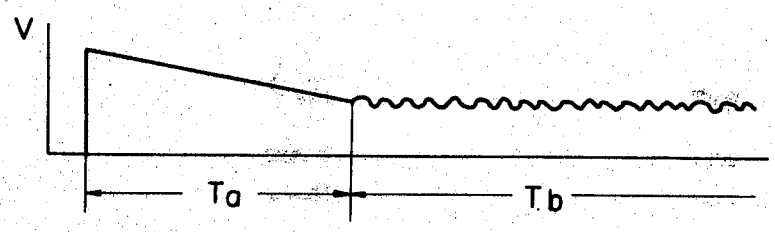
FIG. 11 is a time chart illustrating a change in voltage applied to the non-inverting input terminal of a second comparator.

FIG. 10 illustrates another embodiment of the function generator 81 illustrated in FIG. 4. Referring to FIG. 10, a function generator 90 comprises a proportional circuit 93 and a pair of resistors 91 and 92 interconnected, in series, to each other. The output terminal of the proportional circuit 93 is connected to the second analog switch 82 illustrated in FIG. 4, and the connecting point of the resistors 91 and 92 is connected to the input terminal of the proportional circuit 93. In addition, a thermistor 94, sensitive to the temperature of the cooling water of an engine, is connected, in parallel, to the resistor 91. In this embodiment, since the resistance valve of the thermistor 94 is reduced as the temperature of the cooling water of an engine is increased, the voltage applied to the input terminal of the proportional circuit 93 is increased as the temperature of the cooling water of an engine is increased. Consequently, the output voltage of the proportional circuit 93 is reduced as the temperature of the cooling water of an engine is increased. In FIG. 11, $T_a$ indicates a time period during which the electromagnetic control valve 29 is controlled by the output voltage of the function generator 90 and $T_b$ indicates a time period during which the feedback controlling operation is carried out. In this embodiment, the function generator 90 is so formed that the output voltage thereof is larger than the output voltage of the adder circuit 66, which is produced when the feedback controlling operation is carried out, and that the output voltage of the function generator 90 is gradually reduced as the temperature of the cooling water of an engine is increased.

The choke valve 25 is gradually opened a little while after an engine begins to rotate by its own power. Consequently, the amount of air fed into the metering jet 22 from the air bleed passage 23 is gradually increased as the temperature of the cooling water of an engine is increased. Consequently, if the electromagnetic control valve 26 is maintained in the full open state, there is a danger that the mixture fed into the cylinder of an engine will become to lean. In order to avoid such a danger, in the embodiment illustrated in FIG. 10, as the temperature of the cooling water of an engine is increased, the electromagnetic control valve 26 is gradually closed, so that the amount of air, fed into the metering jet 22 from the air bleed passage 23 via the electromagnetic control valve 26, is gradually reduced.

Figure 12:
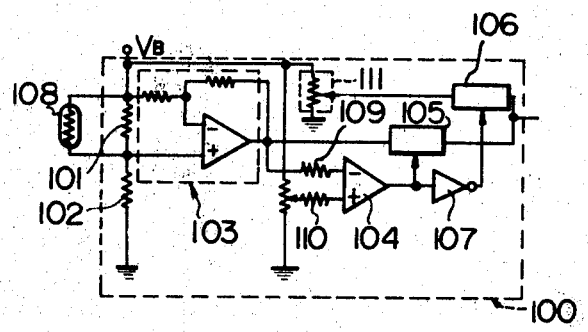
FIG. 12 is a circuit diagram of a further embodiment of an electronic control circuit according to the present invention.

FIG. 12 illustrates a further embodiment of the function generator 81 illustrated in FIG. 4. Referring to FIG. 4, a function generator 100 comprises a pair of resistors 101 and 102 interconnected, in series, to each other, a proportional circuit 103, a comparator 104 and a pair of analog switches 105 and 106. The analog switch 105 is directly controlled by the output voltage of the comparator 104, and the analog switch 106 is controlled by the output voltage of the comparator 104 via an inverter 107. The connecting point of the resistors 101 and 102 is connected to the input terminal of the proportional circuit 103, and a thermistor 108, sensitive to the temperature of the engine body 1 (FIG. 1), is connected, in parallel, to the resistor 101. The output terminal of the proportional circuit 103 is connected, on one hand, to the second analog switch 82 (FIG. 4) via the analog switch 105 and, on the other hand, to the inverting input terminal of the comparator 104 via a resistor 109. A reference voltage is applied to the non-inverting input terminal of the comparator 104 via a resistor 110. In addition, a reference voltage source 111 is connected to the second analog switch 82 (FIG. 4) via the analog switch 106.

Figure 13:
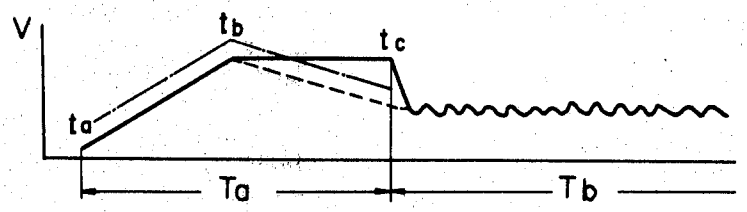
FIG. 13 is a time chart illustrating a change in voltage applied to the non-inverting input terminal of a second comparator.

In FIG. 13, $T_a$ indicates a time period during which the electromagnetic control valve 29 is controlled by the output voltage of the function generator 100 and $T_b$ indicates a time period during which the feedback controlling operation is carried out. In addition, in FIG. 13, $t_a$ indicates a time at which an engine begins to rotate by its own power and that the temperature of the engine body 1 is equal to, for example, −25° C. Furthermore, $t_b$ indicates a time at which the temperature of the engine body 1 becomes equal to about 0° C. and $t_c$ indicates a time at which the temperature of the engine body 1 becomes equal to about 60° C. When an engine begins to rotate by its own power and, thereby, the temperature of the engine body 1 is gradually increased, the resistance valve of the thermistor 97 is gradually reduced. As a result of this, since the voltage, produced at the connecting point of the resistors 101 and 102, is gradually increased, the output voltage of the proportional circuit 103 is gradually increased. At this time, since the output voltage of the proportional circuit 103 is smaller than the reference voltage applied to the non-inverting input terminal of the comparator 104, the output voltage of the comparator 104 is high level. As a result of this, the analog switch 105 is in the conductive state and the analog switch 106 is in the non-conductive state. Therefore, the output voltage of the proportional circuit 103 is applied to the non-inverting input terminal of the second comparator 69 (FIG. 4) via the analog switch 105 and the second analog switch 82 (FIG. 4). During the time period between $t_a$ and $t_b$ in FIG. 13, that is, during the time in which the temperature of the engine body 1 is increased from −25° C. to 0° C., the voltage applied to the non-inverting input terminal of the second comparator (FIG. 4) is continuously increased. When the temperature of the engine body 1 becomes equal to 0° C., since the output voltage of the proportional circuit 103 becomes larger than the reference voltage applied to the non-inverting input terminal of the comparator 104, the output voltage of the comparator 104 becomes low level. As a result of this, the analog switch 105 is turned to the non-conductive state and, at the same time, the analog switch 106 is turned to the conductive state. Consequently, at this time, a fixed voltage of the reference voltage source 111 is applied to the non-inverting input terminal of the second comparator 69 (FIG. 4) via the analog switch 106 and the second analog switch 82 (FIG. 4). Therefore, as illustrated in FIG. 13, during the time period between $t_b$ and $t_c$, the voltage applied to the non-inverting input terminal of the second comparator 69 (FIG. 4) is maintained constant. In addition, from FIG. 9, it will be understood that the voltage applied to the non-inverting input terminal of the second comparator 69 (FIG. 4) during the time period between $t_b$ and $t_c$, is larger than the voltage applied to the non-inverting input terminal of the second comparator 69 (FIG. 4) after the feedback controlling operation is started as indicated within the time period $T_b$. Furthermore, from FIG. 9, it will be also understood that, as the temperature of the engine body 1 (FIG. 1), when an engine begins to rotate by its own power, becomes low, the voltage applied to the non-inverting input terminal of the second comparator 69 (FIG. 4) becomes low. As a result of this, the amount of air fed into the metering jet 22 (FIG. 2) via the electromagnetic control valve 26 is reduced. In an engine, since the viscosity of lubricating oil of an engine is reduced as the temperature of an engine is reduced, a force which is necessary to rotate the crank shaft of an engine is increased as the temperature of an engine is reduced. Therefore, in the embodiment illustrated in FIG. 12, as the temperature of the engine body 1 (FIG. 1) is reduced, the amount of air fed into the metering jet 22 (FIG. 2) via the electromagnetic control valve 26 is reduced as mentioned above. As a result of this, since an air-fuel ratio of the mixture fed into the cylinder of an engine becomes small, a high output power of an engine can be ensured even if the viscosity of lubricating oil of an engine is reduced.

Figure 14:
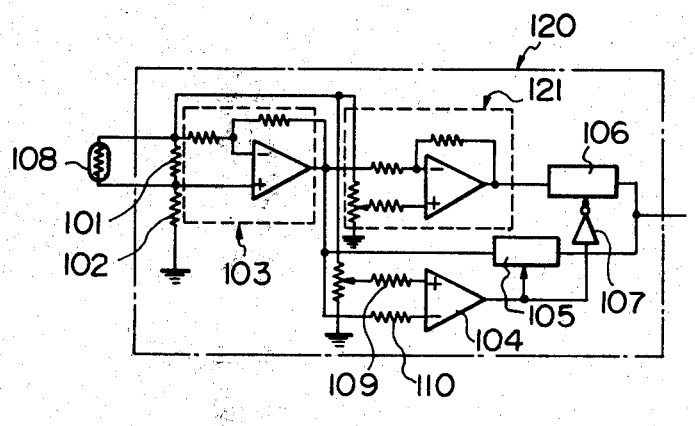
FIG. 14 is a circuit diagram of a still further embodiment of an electronic control circuit according to the present invention.

FIG. 14 illustrates a still further embodiment of the function generator 81 illustrated in FIG. 4. The embodiment illustrated in FIG. 14 has a circuit which is almost the same as that of the embodiment illustrated in FIG. 12, and the embodiment illustrated in FIG. 14 is different from that illustrated in FIG. 12 in only the single point that, in the embodiment illustrated in FIG. 14, a proportional circuit 121 is provided in place of the reference voltage source 111 in FIG. 12. Consequently, in FIG. 14, similar components are indicated with the same reference numerals used in FIG. 12. Referring to FIG. 14, the output terminal of the proportional circuit 103 is connected to the input terminal of the proportional circuit 121 and the output terminal of the proportional circuit 121 is connected to the analog switch 106. In the same manner as described with reference to FIG. 12, when the temperature of the engine body 1 (FIG. 1) is increased beyond 0° C., since the analog switch 106 is turned to the conductive state, the output voltage of the proportional circuit 103 is applied to the non-inverting terminal of the second comparator 69 (FIG. 4) via the proportional circuit 121 and the analog switch 106. At this time, since the proportional circuit 121 is an inverting amplifier, the output voltage of the proportional circuit 103 is inverted in the proportional circuit 121. Therefore, as illustrated by the broken line in FIG. 13, during the time period between $t_b$ and $t_c$, the voltage applied to the non-inverting input terminal of the second comparator 69 (FIG. 4) is reduced as the temperature of the engine body 1 (FIG. 1) is increased. Then, this voltage is smoothly connected to the output voltage of the adder circuit 66 (FIG. 4) when the feedback controlling operation is started. On the other hand, when the temperature of the engine body 1 (FIG. 1) is lower than 0° C., the analog switch 105 is turned to the conductive state. Therefore, as illustrated by the broken line in FIG. 13, during the time period between $t_a$ and $t_b$, the voltage applied to the non-inverting input terminal of the second comparator 69 (FIG. 4) is increased as the temperature of the engine body 1 (FIG. 1) is increased.

Figure 15:
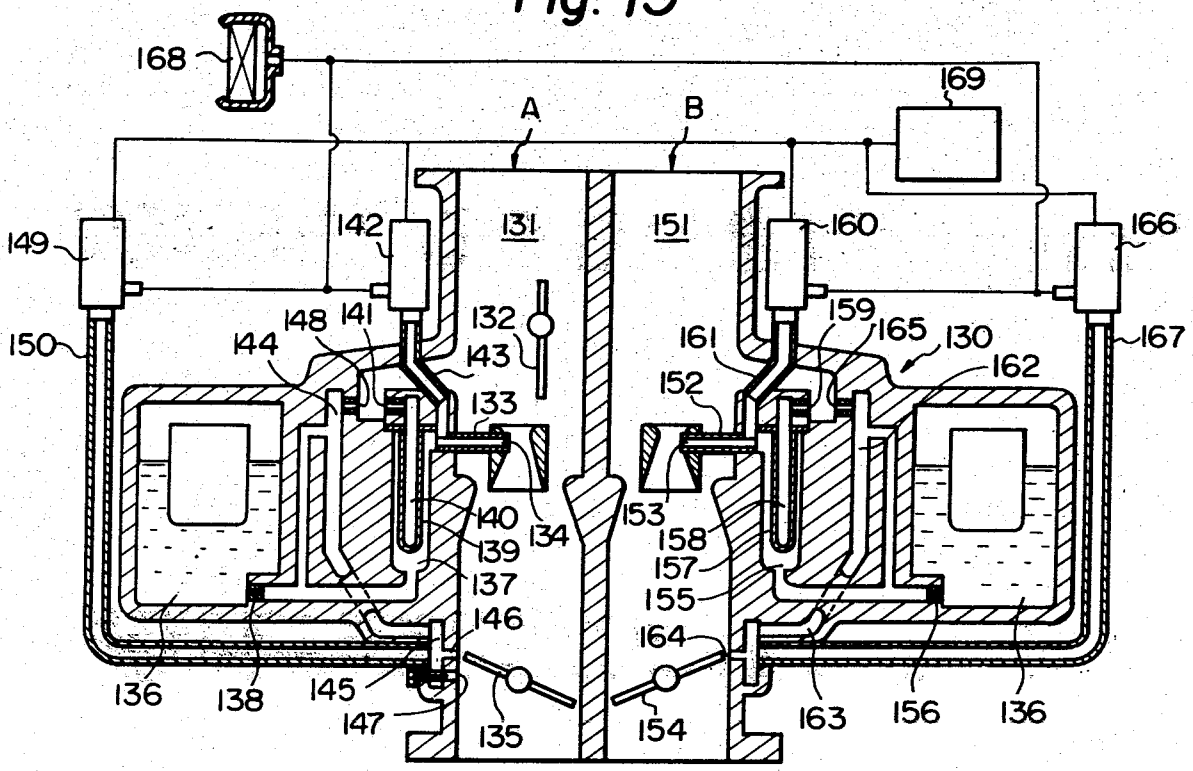
FIG. 15 is a cross-sectional side view of another embodiment of a carburetor according to the present invention.
Figure 16:
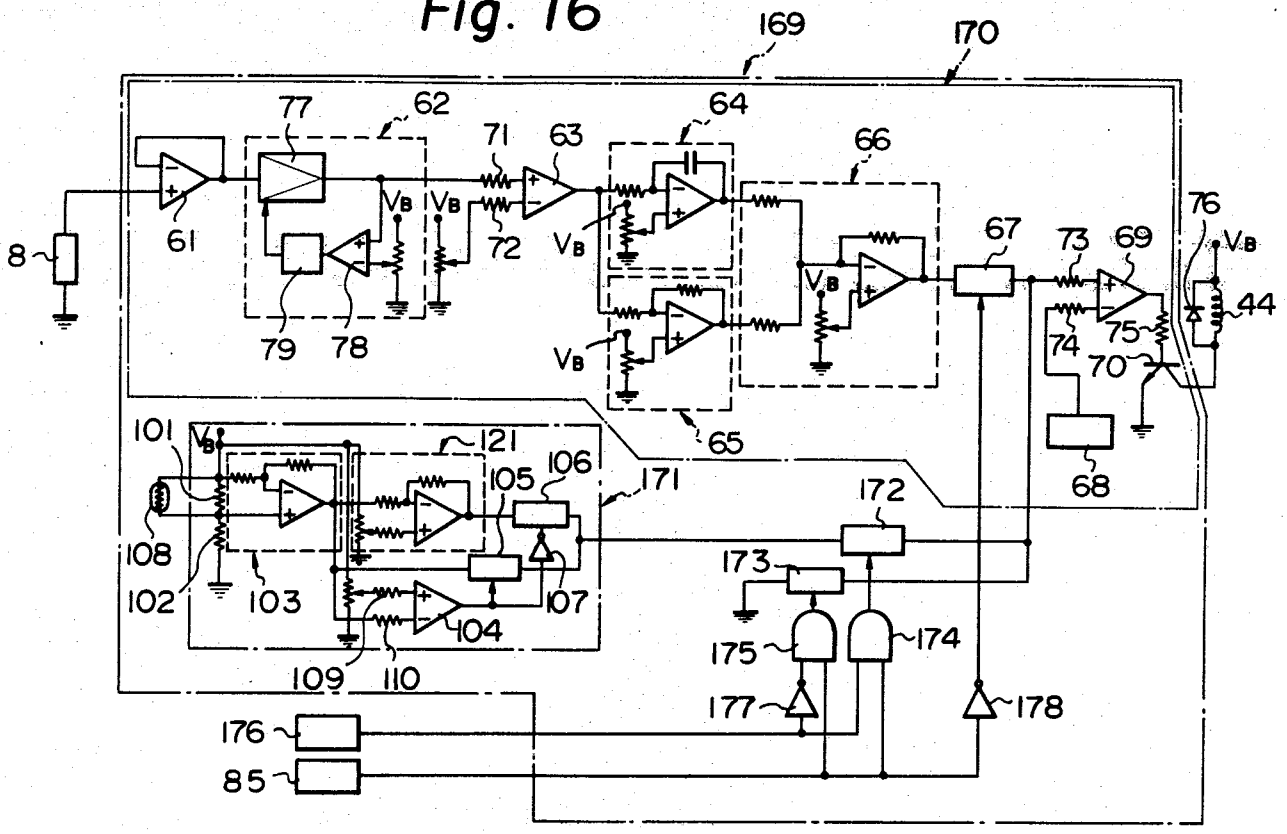
FIG. 16 is a circuit diagram of a still further embodiment of an electronic control circuit according to the present invention.

FIGS. 15 and 16 illustrate another embodiment of a carburetor according to the present invention. Referring to FIG. 15, a carburetor 130 comprises a primary carburetor A and a secondary carburetor B. The primary carburetor A comprises an air horn 131, a choke valve 132, a main nozzle tube 133 having a nozzle mouth 134 and a primary throttle valve 135. The main nozzle tube 133 is connected to a float chamber 136 via a main fuel passage 137 and a main jet 138. An emulsion tube 139 is arranged in the main fuel passage 137, and the interior chamber 140 of the emulsion tube 139 is connected to the air horn 131 via a fixed jet 141. In addition, the inner end of the main nozzle tube 133 is connected to an electromagnetic control valve 142 via an air bleed conduit 143. A slow fuel passage 144 is branched off from the main fuel passage 137, and connected to a fuel outflow chamber 145 having a slow fuel port 146 and an idle fuel port 147 which open into the air horn 131 in the vicinity of the primary throttle valve 135. In addition, the slow fuel passage 144 is connected to the air horn 131 via a fixed jet 148 and the fuel outflow chamber 145 is connected to an electromagnetic control valve 149 via an air bleed conduit 150.

The secondary carburetor B comprises an air horn 151, a main nozzle tube 152 having a nozzle mouth 153 and a secondary throttle valve 154. The main nozzle tube 152 is connected to the float chamber 136 via a main fuel passage 155 and a main jet 156. An emulsion tube 157 is arranged in the main fuel passage 155 and the interior chamber 158 of the emulsion tube 157 is connected to the air horn 151 via a fixed jet 159. In addition, the inner end of the main nozzle tube 152 is connected to an electromagnetic control valve 160 via an air bleed conduit 161. A slow fuel passage 162 is branched off from the main fuel passage 155 and connected to a fuel outflow chamber 163, having a slow fuel port 164 which opens into the air horn 151 in the vicinity of the secondary throttle valve 154. The slow fuel passage 162 is connected to the air horn 151 via a fixed jet 165 and the fuel outflow chamber 163 is connected to an electromagnetic control valve 166 via an air bleed conduit 167. In addition, the carburetor 130 comprises a choke valve actuating mechanism (not shown) for automatically fully closing the choke valve 132 when an engine is started and for gradually opening the choke valve 132 as the temperature of an engine is increased.

Each of the electromagnetic control valves 142, 149, 160 and 166 has a construction which is the same as that of the electromagnetic control valve 26 illustrated in FIG. 3. Consequently, each of the electromagnetic control valves 142, 149, 160 and 166 comprises an air inlet 49, an air outlet 50 and a coil 44 as illustrated in FIG. 3. The air inlets 49 of the electromagnetic control valves 142, 149, 160 and 166 are connected to the atmosphere via a common air filter 168, as illustrated in FIG. 15, and the air outlets 50 of the electromagnetic control valves 142, 149, 160 and 166 are connected to the corresponding air bleed conduits 143, 150, 161 and 167, respectively. In addition, the coils 44 of the electromagnetic control valves 142, 149, 160 and 166 are connected to the electronic control circuit 169.

Referring to FIG. 16, the electronic control circuit 169 comprises a feedback control portion 170 and a function generator 171. The feedback control portion 170 has a circuit which is the same as the corresponding portion of the electronic control circuit 60 illustrated in FIG. 4 and, therefore, in FIG. 16, similar components are indicated with the same reference numerals used in FIG. 4. In addition, the function generator 171 has a circuit which is the same as that of the function generator 120 illustrated in FIG. 14 and, therefore, in FIG. 16, similar components are indicated with the same reference numerals used in FIG. 14. As illustrated in FIG. 16, the electronic control circuit 169 comprises a second analog switch 172, a third analog switch 173 and a pair of AND gates 174 and 175. The output terminal of the function generator 171 is connected via the second analog switch 172 to the connecting point of the first analog switch 67 and the resistor 73, and this connecting point is grounded via the third analog switch 173. The second analog switch 172 and the third analog switch 173 are directly controlled by the output voltages of the AND gates 174 and 175, respectively. One of the input terminals of the AND gate 175 is connected to a vacuum reactive switch 176 via an inverter 177, and the other input terminal of the AND gate 175 is connected to the temperature reactive switch 85. In addition, one of the input terminals of the AND gate 174 is connected to the vacuum reactive switch 176 and the other input terminal of the AND gate 174 is connected to the temperature reactive switch 85. The first analog switch 67 is controlled by the temperature reactive switch 85 via an inverter 178. As illustrated in FIG. 1, the vacuum reactive switch 176 is mounted on the intake manifold 2. The vacuum reactive switch 176 is in the OFF condition when the level of vacuum produced in the intake manifold 2 is smaller than −100 mmHg, while the vacuum reactive switch 176 is turned to the ON condition when the level of vacuum produced in the intake manifold 2 becomes greater than −100 mmHg. As mentioned previously, the temperature reactive switch 85 is in the ON condition when the temperature of the cooling water of an engine is lower than 60° C., while the temperature reactive switch 85 is turned to the OFF condition when the temperature of the cooling water of an engine is increased beyond 60° C.

When the temperature of the cooling water of an engine is lower than 60° C., that is, at the time of warm-up of an engine, the temperature reactive switch 85 is in the ON condition as mentioned above and, as a result, the first analog switch 67 is in the conductive state. At this time, if the level of vacuum produced in the intake manifold 2 is greater than −100 mmHg, the vacuum reactive switch 176 is in the ON condition as mentioned above, As a result of this, the output voltage of the AND gate 175 becomes low level and the output voltage of the AND gate 174 becomes high level. Therefore, since the second analog switch 172 is in the conductive state and the third analog switch 173 is in the non-conductive state, the output voltage of the function generator 171 is applied to the non-inverting input terminal of the second comparator 69 via the second analog switch 172. As mentioned above, the function generator 171 has a circuit which is the same as that of the function generator 120 illustrated in FIG. 14. Consequently, the function generator 171 produces an output voltage illustrated by the broken line in FIG. 13, and this output voltage is applied to the non-inverting input terminal of the second comparator 69. As a result of this, in FIG. 15, since the electromagnetic control valves 142, 149, 160 and 166 are opened, ambient air is fed into the air bleed conduits 143, 150, 161 and 167 via the air filter 168, and the corresponding electromagnetic control valves 142, 149, 160 and 166. Therefore, even if the choke valve 132 is closed, an air-fuel ratio of the mixture, fed into the cylinder of an engine, becomes large and, as a result, it is possible to reduce the amount of harmful HC and CO components in the exhaust gas.

In the case wherein the temperature of the cooling water of an engine is lower than 60° C., if an engine is operated under a high load and, thereby, the level of vacuum produced in the intake manifold 2 becomes smaller than −100 mmHg, in FIG. 16, the vacuum reactive switch 176 is turned to the OFF condition. As a result of this, since the output voltage of the AND gate 174 becomes low level, the second analog switch 172 is turned to the non-conductive state. At the same time, since the output voltage of the AND gate 175 becomes high level, the third analog switch 173 is turned to the conductive state. Thus, since the non-inverting input terminal of the second comparator 69 is grounded via the third analog switch 173, the second comparator 69 does not produce an output voltage, and as a result, the electromagnetic control valves 142, 149, 160 and 166 are completely closed. Consequently, since the bleeding operation of air fed into the air bleed conduits 143, 150, 161 and 167 is stopped, an air-fuel ratio of the mixture fed into the cylinder of an engine becomes small. As a result of this, when an engine is operated under a heavy load before completion of warm-up of the engine, a high output power of the engine can be ensured. In the embodiment illustrated in FIG. 16, the non-inverting input terminal of the second comparator 69 is grounded via the third analog switch 173. However, instead of grounding the non-inverting input terminal of the second comparator 69 via the third analog switch 173, the non-inverting input terminal of the second comparator 69 may be connected via the third analog switch 173 to another function generator producing an output voltage which is lower than that of the function generator 171.

As mentioned above, when the temperature of the cooling water of an engine is increased beyond 60° C., the temperature reactive switch 85 is turned to the OFF condition. At this time, since the output voltage of both the AND gates 174 and 175 becomes low level, the second analog switch 172 and the third analog switch 173 are turned to the non-conductive state, and in addition, the first analog switch 67 is turned to the conductive state. As a result of this, the feedback controlling operation of the electronic control circuit 169 is started.

Figure 17:
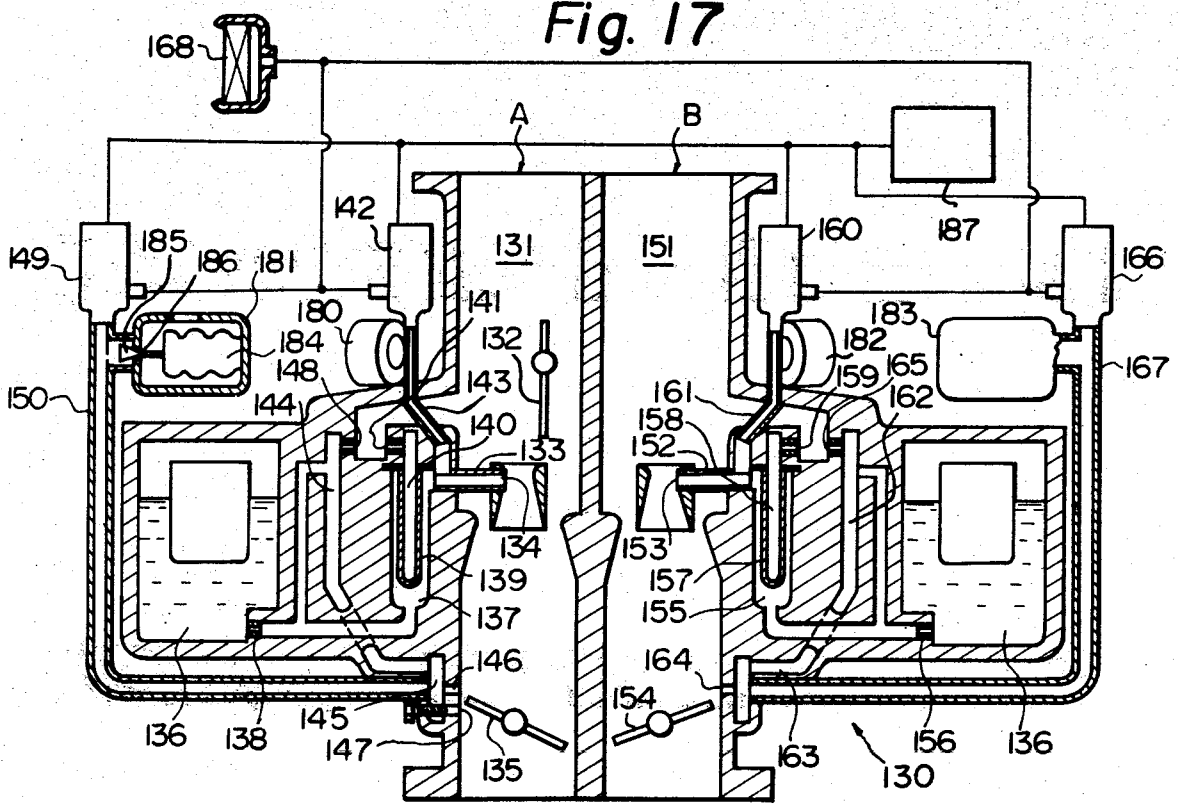
FIG. 17 is a cross-sectional side view of a further embodiment of a carburetor according to the present invention.
Figure 18:
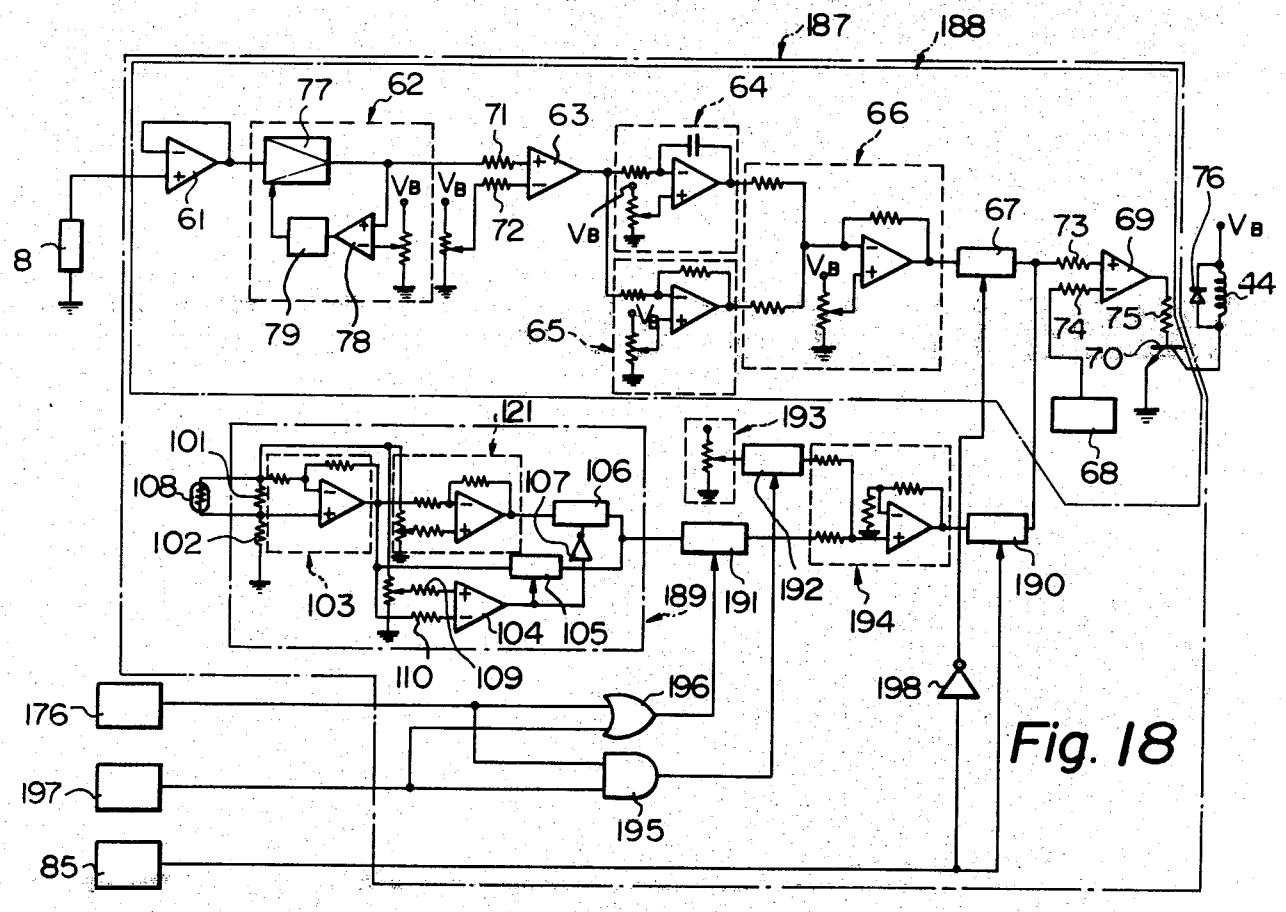
FIG. 18 is a circuit diagram of a still further embodiment of an electronic control circuit according to the present invention.

FIGS. 17 and 18 illustrate a further embodiment of a carburetor according to the present invention. The embodiment illustrated in FIG. 17 is different from the embodiment illustrated in FIG. 15 in only a single point wherein, in the embodiment illustrated in FIG. 17, air bleed control valves 180, 181, 182 and 183 are provided. Consequently, in FIG. 17, similar components are indicated with the same reference numerals used in FIG. 15. Referring to FIG. 17, the air bleed control valves 180, 181, 182 and 183 of bellows controlled type are mounted on the air bleed conduits 143, 150, 161 and 167, respectively. The air bleed control valves 180, 181, 182 and 183 have the same construction, and therefore, the construction of only the air bleed control valve 181 will be hereinafter described. The air bleed control valve 181 comprises a bellows 184 and a valve body 185 fixed onto the tip of the bellows 184, and controlling the flow area of a valve port 185. In general, when a motor vehicle is driven at a high altitude, since the density of ambient air becomes low, the mixture, fed into the cylinder of the engine, becomes rich. However, in the embodiment illustrated in FIG. 17, when ambient atmospheric pressure is reduced, as in the case wherein a motor vehicle is driven at a high altitude, since the bellows 184 expands, the valve body 185 moves towards the left in FIG. 17. As a result of this, since the flow area of the valve port 185 is increased, the amount of air fed into the fuel outflow chamber 145 via the valve port 185 is increased. Thus, an air-fuel ratio of the mixture fed into the cylinder of an engine becomes large and, therefore, it is possible to prevent the mixture fed into the cylinder of an engine from becoming rich. In addition, in the embodiment illustrated in FIG. 17, the electromagnetic control valves 142, 149, 160 and 166 are controlled by an electronic control circuit 187.

Referring to FIG. 18, the electronic control circuit 187 comprises a feedback control portion 188 and a function generator 189. The feedback control portion 188 has a circuit which is the same as the corresponding portion of the electronic control circuit 60 illustrated in FIG. 4 and, therefore, in FIG. 18, similar components are indicated with the same reference numerals used in FIG. 4. In addition, the function generator 189 has a circuit which is the same as that of the function generator 120 illustrated in FIG. 14 and, therefore, in FIG. 18, similar components are indicated with the same reference numerals used in FIG. 14. As illustrated in FIG 18, the electronic control circuit 187 comprises a second analog switch 190, a third analog switch 191, a fourth analog switch 192, another function generator 193, another adder circuit 194, an AND gate 195 and an OR gate 196. The output terminal of the function generator 189 is connected to a first input terminal of the adder circuit 194 via the third analog switch 191 and the output terminal of the function generator 193 is connected to a second input terminal of the adder circuit 194 via the fourth analog switch 192. In addition, the output terminal of the adder circuit 194 is connected via the second analog switch 190 to the connecting point of the first analog switch 97 and the resistor 73. One of the input terminals of the AND gate 195 is connected to the vacuum reactive switch 176 and the other input terminal of the AND gate 195 is connected to an atmospheric pressure reactive switch 197. One of the input terminals of the OR gate 196 is connected to the vacuum reactive switch 176 and the other input terminal of the OR gate 196 is connected to the atmospheric pressure reactive switch 197. The first analog switch 67 is controlled by the temperature reactive switch 85 via an inverter 198 and the second analog switch 190 is directly controlled by the temperature reactive switch 85. In addition, the third analog switch 191 is controlled by the output voltage of the OR gate 196 and the fourth analog switch 192 is controlled by the output voltage of the AND gate 195. The atmospheric pressure reactive switch 197 is in the ON condition when an atmospheric pressure is less than 625 mmHg, while the atmospheric pressure reactive switch 197 is turned to the OFF condition when an atmospheric pressure is larger than 625 mmHg. As mentioned previously, the vacuum reactive switch 176 is in the OFF condition when the level of vacuum produced in the intake manifold 2 is smaller than −100 mmHg, while the vacuum reactive switch 176 is turned to the ON condition when the level of vacuum produced in the intake manifold 2 becomes greater than −100 mmHg. In addition, as mentioned previously, the temperatures reactive switch 85 is in the ON condition when the temperature of the cooling water of an engine is lower than 60° C., while the temperature reactive switch 85 is turned to the OFF condition when the temperature of the cooling water of an engine is increased beyond 60° C.

When the temperature of the cooling water of an engine is lower than 60° C., that is, at the time of warm-up of an engine, the temperature reactive switch 85 is in the ON condition. As a result of this, the first analog switch 67 is in the non-conductive state and the second analog switch 190 is in the conductive state. At this time, if the level of vacuum produced in the intake manifold 2 is greater than −100 mmHg and an atmospheric pressure is higher than 625 mmHg, the vacuum reactive switch 176 is in the ON condition, and in addition, the atmospheric pressure reactive switch 197 is in the OFF condition, as mentioned above. As a result of this, since the output voltage of the OR gate 196 becomes high level, the third analog switch 191 is turned to the conductive state. At the same time, since the output voltage of the AND gate 195 becomes low level, the fourth analog switch 192 is turned to the non-conductive state. Consequently, at this time, the output voltage of only the function generator 189 is applied to the adder circuit 194 via the third analog switch 191 and the output voltage of the adder circuit 194 is applied to the non-inverting input terminal of the second comparator 69 via the second analog switch 190. Therefore, the voltage applied to the non-inverting input terminal of the second comparator 69 becomes equal to the output voltage of the function generator 189. As mentioned above, the function generator 171 has a circuit which is the same as that of the function generator 120 illustrated in FIG. 14. Consequently, the function generator 189 produces an output voltage illustrated by the broken line in FIG. 13, and this output voltage is applied to the non-inverting input terminal of the second comparator 69. As a result of this, in FIG. 17, since the electromagnetic control valves 142, 149, 160 and 166 are opened, ambient air is fed into the air bleed conduits 143, 150, 161 and 167 via the air filter 168, and the corresponding electromagnetic control valves 142, 149, 160 and 166. Therefore, even if the choke valve 132 is closed, an air-fuel ratio of the mixture fed into the cylinder of an engine becomes large, and as a result, it is possible to reduce the amount of harmful HC and CO components in the exhaust gas.

In the case wherein the temperature of the cooling water of an engine is lower than 60° C. and the level of vacuum produced in the intake manifold 2 is greater than −100 mmHg, if a motor vehicle is driven at a high altitude, and thus, the atmospheric pressure becomes lower than 625 mmHg, the vacuum reactive switch 176 remains in the ON condition, but the atmospheric pressure reactive switch 197 is turned to the ON condition. As a result of this, since the output voltage of both the OR gate 196 and the AND gate 195 become high level, the third analog switch 191 remains in the conductive state, and the fourth analog switch 192 is turned to the conductive state. Consequently, at this time, the output voltage of the function generator 189 and the output voltage of the function generator 193 are added in the adder circuit 194, and the voltage thus added is applied to the non-inverting input terminal of the second comparator 69 via the second analog switch 190. From FIG. 18, it will be understood that the function generator 193 is a fixed voltage source. Consequently, the voltage, applied to the non-inverting input terminal of the second comparator 69, is as illustrated by the dash and dot line in FIG. 13.

As mentioned above, in the embodiment illustrated in FIG. 17, when a motor vehicle is driven at a high altitude, since ambient air is fed into the air bleed passages 143, 150, 161 and 167 via the air bleed control valves 180, 181, 182 and 183, respectively, it is possible to increase the air-fuel ratio of the mixture fed into the cylinder of the engine. However, in an engine equipped with the bellows controlled type air bleed control valves 180, 181, 182 and 183, if the air bleed control valves 180, 181, 182 and 183 are so adjusted that the amount of air, fed into the air bleed conduits 143, 150, 161 and 167 via the corresponding air bleed control valves 180, 181, 182 and 183, becomes optimum after completion of warm-up of the engine, the amount of air, fed into the air bleed conduits 143, 150, 161 and 1667 via the corresponding air bleed control valves 180, 181, 182 and 183, becomes smaller than an optimum amount before completion of warm-up of the engine. As a result of this, in the case wherein a motor vehicle is driven at a high altitude before completion of warm-up of the engine, since the mixture fed into the cylinder of the engine becomes rich, a problem occurs in that the amount of harmful HC and CO components in the exhaust gas is increased. Nevertheless, in the embodiment illustrated in FIGS. 17 and 18, since a high voltage, illustrated by the dash and dot line in FIG. 13, is applied to the non-inverting input terminal of the second comparator 69 before completion of warm-up of the engine, a large amount of air is fed into the air bleed conduits 143, 150, 161 and 167 via the electromagnetic control valves 142, 149, 160 and 166, respectively. As a result of this, in the case wherein a motor vehicle is driven at a high altitude before completion of warm-up of the engine, it is possible to prevent the mixture fed into the cylinder of an engine from becoming rich.

In the case wherein the temperature of the cooling water of an engine is lower than 60° C., and an atmospheric pressure is lower than 625 mmHg, if the engine is operated under a high load and, thus, the level of vacuum produced in the intake manifold 2 becomes smaller than −100 mmHg, the atmospheric pressure reactive switch 197 remains in the ON condition, and the vacuum reactive switch 176 is turned to the OFF condition. As a result of this, the third analog switch 191 remains in the conductive state and the fourth analog switch 192 is turned to the non-conductive state. Consequently, at this time, the voltage applied to the non-inverting input terminal of the second comparator 69 becomes equal to the output voltage of the function generator 189, which is illustrated by the broken line in FIG. 13. Therefore, in the case wherein a motor vehicle is driven at a high altitude before completion of warm-up of the engine, if the load of the engine is increased, the voltage applied to the non-inverting input terminal of the second comparator 69 is reduced from the level, illustrated by the dash and dot line in FIG. 13, to the level illustrated by the broken line in FIG. 13. As a result of this, since the amount of air fed into the air bleed conduits 143, 150, 161 and 167 is reduced, the air-fuel ratio of the mixture fed into the cylinder of the engine becomes small and, thus, a high output power of the engine can be ensured when the engine is operated under a heavy load.

In the case wherein the temperature of the cooling water is lower than 60° C., if an engine is operated under a heavy load at a low altitude, the vacuum reactive switch 176 is in the OFF condition and the atmospheric pressure reactive switch 197 is in the OFF condition. As a result of this, since the output voltage of both the OR gate 196 and the AND gate 195 becomes low level, both the third analog switch 191 and the fourth analog switch 192 are in the non-conductive state. Consequently, since the electromagnetic control valves 142, 149, 160 and 166 are closed, the air-fuel ratio of the mixture fed into the cylinder of the engine becomes small, and as a result, a high output power of an engine can be ensured.

As mentioned above, when the temperature of the cooling water of an engine is increased beyond 60° C., the temperature reactive switch 85 is turned to the OFF condition. As a result of this, since the second analog switch 190 is turned to the non-conductive state and the first analog switch 67 is turned to the conductive state, the feedback controlling operation of the electronic control circuit 187 is started.

While the invention has been described by reference to specific embodiments chosen for purposes of illustration, it should be apparent that numerous modifications could be made thereto by those skilled in the art without departing from the spirit and scope of the invention.

We claim:

1. An air-fuel ratio control device of an internal combustion engine having at least one cylinder, an intake passage and an exhaust passage, said device comprising:

a carburetor arranged in the intake passage and having a choke apparatus for reducing an air-fuel ratio of a mixture fed into the cylinder from said carburetor when the engine is started, said carburetor having a fuel reservoir and a fuel outflow passage which interconnects said reservoir to the intake passage;

an air bleed passage interconnecting said fuel outflow passage to the atmosphere for feeding air into said fuel outflow passage;

a temperature reactive switch for detecting the temperature of the engine to produce a detecting signal indicating whether the temperature of the engine is lower or higher than a first predetermined temperature;

an air-fuel ratio detector arranged in the exhaust passage and detecting components of an exhaust gas in the exhaust passage for producing a detecting signal which has a potential level which becomes high or low when the air-fuel ratio of said mixture becomes less or larger than the stoichiometric air-fuel ratio, respectively;

a detecting signal processing circuit having a first comparator for comparing the level of the detecting signal of said air-fuel ratio detector with a reference voltage to produce an output voltage, said processing circuit having an integrating circuit for integrating the output voltage of said first comparator to produce a first control signal having a level which varies within a fixed range of voltage and becomes large as the air-fuel ratio of said mixture becomes small;

control voltage generating means for generating a second control signal having a first level which is larger than said fixed range of voltage;

switching means in response to the detecting signal of said temperature reactive switch for selectively producing an output voltage which is equal to the level of said first control signal or the level of said second control signal when the temperature of the engine is higher or lower than said first predetermined temperature, respectively;

a drive pulse generator for generating continuous drive pulses, each having a width which is proportional to the output voltage of said switching means, and;

control valve means arranged in said air bleed passage and actuated in response to said drive pulses for increasing a flow area of said air bleed passage in accordance with an increase in the width of said drive pulse.

2. An air-fuel ratio control device as claimed in claim 1, wherein said control value means comprises a linear motor.

3. An air-fuel ratio control device as claimed in claim 1, wherein said carburetor is a variable venturi type carburetor and comprises an air horn, a suction piston reciprocally movable in said air horn, a metering jet arranged in said fuel outflow passage, and a metering needle fixed onto said suction piston and cooperating with said metering jet, said fuel outflow passage within said metering jet being connected to said air horn via said air bleed passage, said choke apparatus and said control valve means being arranged in parallel in said air bleed passage.

4. An air-fuel ratio control device as claimed in claim 3, wherein said choke apparatus comprises an air bleed control valve which is movable from a completely closed position, wherein said air bleed control valve completely closes said air bleed passage, to a fully opened position, wherein said air bleed control valve fully opens said air bleed passage.

5. An air-fuel ratio control device as claimed in claim 4, wherein said choke apparatus comprises a wax valve connected to said air bleed control valve for actuating it, and a heater for heating said wax valve after the engine is started, said air bleed control valve being located at said completely closed position immediately after the engine is started and gradually opening as the temperature of the engine is increased.

6. An air-fuel ratio control device as claimed in claim 3, wherein said carburetor further comprises a normally closed power valve arranged in said air bleed passage in parallel to both said choke apparatus and said control valve means for opening said air bleed passage when the level of vacuum, which is produced in the intake passage located downstream of a throttle valve of said carburetor, becomes greater than a predetermined level.

7. An air-fuel ratio control device as claimed in claim 6, wherein said power valve comprises a spring loaded piston defining a vacuum chamber which is connected to the intake passage located downstream of the throttle valve of said carburetor, said piston being actuated by the vacuum produced in the intake passage.

8. An air-fuel ratio control device as claimed in claim 1, wherein said carburetor is a fixed venturi type carburetor and comprises a primary air horn, a primary throttle valve arranged in said primary air horn, a secondary air horn and a secondary throttle valve arranged in said secondary air horn, said fuel outflow passage comprising a primary main fuel passage connected to said primary air horn, a primary slow fuel passage connected to said primary air horn at a position near said primary throttle valve, a secondary main fuel passage connected to said secondary air horn, and a secondary slow fuel passage connected to said secondary air horn at a position near said secondary throttle valve, said air bleed passage comprises a first passage, a second passage, a third passage and a fourth passage which are connected to said primary main fuel passage, said primary slow fuel passage, said secondary main fuel passage and said secondary slow fuel passage, respectively, said control valve means comprising first valve, a second valve, a third valve and fourth valve which are arranged in said first passage, said second passage, said third passage and said fourth passage, respectively.

9. An air-fuel ratio control device as claimed in claim 8, wherein all of said first passage, said second passage, said third passage and said fourth passage are connected to the atmosphere via a common air filter.

10. An air-fuel ratio control device as claimed in claim 8, wherein said carburetor comprises a primary nozzle tube and a secondary nozzle tube which define said primary main fuel passage and said secondary main fuel passage therein, and have one end supported by inner walls of said primary air horn and said secondary air horn, respectively, said first passage and said third passage being connected to said one end of said primary nozzle tube and said secondary nozzle tube, respectively.

11. An air-fuel ratio control device as claimed in claim 8, wherein said primary slow fuel passage has a primary fuel outflow chamber located near said primary throttle valve and connected to said primary air horn via a slow fuel port and an idle fuel port, said secondary slow fuel passage having a secondary fuel outflow chamber located near said secondary throttle valve and connected to said secondary air horn via a slow fuel port, said second passage and said fourth passage being connected to said primary fuel outflow chamber and said secondary fuel outflow chamber, respectively.

12. An air-fuel ratio control device as claimed in claim 8, wherein said choke apparatus comprises a choke valve arranged in said primary air horn.

13. An air-fuel ratio control device as claimed in claim 8, wherein said first passage, said second passage, said third passage and said fourth passage are connected to the atmosphere via corresponding air bleed control valves for increasing the amount of air fed into said first passage, said second passage, said third passage and said fourth passage, as the ambient atmospheric pressure is reduced.

14. An air-fuel ratio control device as claimed in claim 13, wherein each of said air bleed control valves comprises an ambient air inflow port, a valve head cooperating with said inflow port, and a bellows connected to said valve head and gradually expanding as the ambient atmospheric pressure is reduced.

15. An air-fuel ratio control device as claimed in claim 1, wherein said detecting signal processing circuit comprises a voltage follower inserted between said air-fuel ratio detector and said first comparator.

16. An air-fuel ratio control device as claimed in claim 15, wherein said detecting signal processing circuit comprises an AGC circuit inserted between said voltage follower and said first comparator.

17. An air-fuel ratio control device as claimed in claim 1, wherein said detecting signal processing circuit comprises a proportional circuit for producing an output voltage which is proportional to that of said first comparator, and an adder circuit for adding the output voltage of said proportional circuit and an output voltage of said integrating circuit to produce said first control signal.

18. An air-fuel ratio control device as claimed in claim 1, wherein said drive pulse generator comprises a saw tooth shaped wave generator for generating a saw tooth shaped output voltage, and a second comparator for comparing the output voltage of said switching means and the output voltage of said generator to produce said drive pulses when the output voltage of said switching means becomes larger than that of said generator.

19. An air-fuel ratio control device as claimed in claim 1, wherein said control voltage generating means comprises a function generator generating said second control signal having said fixed first level.

20. An air-fuel ratio control device as claimed in claim 1, wherein said control voltage generating means comprises a thermistor sensitive to the temperature of the engine and a function generator generating said second control signal of said first level which is gradually reduced in response to a change in resistance value of said thermistor as the temperature of the engine is increased.

21. An air-fuel ratio control device as claimed in claim 20, wherein said function generator comprises a proportional circuit, and a pair of resistors connected in series between a ground and a power source, said thermistor being connected in parallel to one of said resistors, said proportional circuit producing said second control signal of said first level which is changed in accordance with a change in voltage produced at a connecting point of said resistors.

22. An air-fuel ratio control device as claimed in claim 20, wherein said function generator generates said second control signal of said first level which becomes approximately equal to said fixed range of said first control signal when the temperature of the engine reaches said first predetermined temperature.

23. An air-fuel ratio control device as claimed in claim 1, wherein said control voltage generating means comprises a thermistor sensitive to the temperature of the engine, and a function generator generating said second control signal which has said first level and a second level, said second control signal becoming said first level when the temperature of the engine is higher than a second predetermined temperature and less than said first predetermined temperature, said second control signal becoming said second level when the temperature of the engine is lower than said second predetermined temperature, said second level being gradually increased towards said first level in response to a change in resistance value of said thermistor as the temperature of the engine is increased.

24. An air-fuel ratio control device as claimed in claim 23, wherein said function generator comprises: a proportional circuit; a voltage generator for generating an output voltage; a pair of resistors connected in series between a ground and a power source, said thermistor being connected in parallel to one of said resistors, said proportional circuit producing an output voltage which is changed in accordance with a change in voltage produced at a connecting point of said resistor; a second comparator for comparing the output voltage of said proportional circuit with a reference voltage to produce an output voltage indicating whether the temperature of the engine is lower or higher than said second predetermined temperature; an analog switch directly controlled by the output voltage of said second comparator and passing the output voltage of said proportional circuit therethrough for producing said second control signal of said second level when the temperature of the engine is lower than said second predetermined temperature, and; an analog switch controlled by the output voltage of said second comparator via an inverter and passing the output voltage of said voltage generator therethrough for producing said second control signal of said first level when the temperature of the engine is higher than said second predetermined temperature.

25. An air-fuel ratio control device as claimed in claim 24, wherein said voltage generator generates said second control signal having said fixed first level.

26. An air-fuel ratio control device as claimed in claim 24, wherein said voltage generator comprises an inverting amplifier for inverting the output voltage of said proportional circuit to produce said second control signal of said first level which is gradually reduced as the temperature of the engine is increased.

27. An air-fuel ratio control device as claimed in claim 26, wherein said voltage generator generates said second control signal of said first level which becomes approximately equal to said fixed range of said first control signal when the temperature of the engine reaches said first predetermined temperature.

28. An air-fuel ratio control device as claimed in claim 1, wherein said switching means comprises a first analog switch controlled by the detecting signal of said temperature reactive switch and passing said first control signal therethrough to feed said first control signal into said drive pulse generator when the temperature of the engine is higher than said first predetermined temperature, said switching means comprising a second analog switch which is controlled by the detecting signal of said temperature reactive switch and passes said second control signal therethrough to feed said second control signal into said drive pulse generator when the temperature of the engine is lower than said first predetermined temperature.

29. An air-fuel ratio control device as claimed in claim 28, wherein said temperature reactive switch is turned to the ON condition when the temperature of the engine is lower than said first predetermined temperature, said first analog switch being controlled by the detecting signal of said temperature reactive switch via an inverter, said second analog switch being directly controlled by the detecting signal of said temperature reactive switch.

30. An air-fuel ratio control device as claimed in claim 1, wherein said switching means comprises an engine operation detector for producing a detecting signal indicating whether the engine is rotating by its own power when the engine is started, said switching means being operated in response to the detecting signal of said engine operation detector for feeding said second control signal into said drive pulse generator when the temperature of the engine is lower than said first predetermined temperature and when the engine is rotating by its own power, said detecting means feeding said first control signal into said drive pulse generator when the temperature of the engine is higher than said first predetermined temperature and when the engine is not rotating by its own power.

31. An air-fuel ratio control device as claimed in claim 30, wherein said first control signal has a potential level which is equal to zero when the engine is not rotating by its own power.

32. An air-fuel ratio control device as claimed in claim 30, wherein said switching means comprises an AND gate having a first input terminal and a second input terminal, a first analog switch controlled by an output voltage of said AND gate and inserted between said detecting signal processing circuit and said drive pulse generator, and a second analog switch controlled by the output voltage of said AND gate and inserted between said control voltage generating means and said drive pulse generator, said first input terminal and said second input terminal being connected to said temperature reactive switch and said engine operation detector, respectively.

33. An air-fuel ratio control device as claimed in claim 32, wherein said temperature reactive switch is turned to the ON condition when the temperature of the engine is lower than said first predetermined temperature, said engine operation detector detecting a voltage produced at a neutral point of an alternator which is driven by the engine, said first analog switch being controlled by the output voltage of said AND gate and passing said first control signal therethrough when the temperature of the engine is higher than said first predetermined temperature and when the engine is not rotating by its own power, said second analog switch being directly controlled by the output voltage of said AND gate and passing said first control signal therethrough when the temperature of the engine is lower than said first predetermined temperature and when the engine is rotating by its own power.

34. An air-fuel ratio control device as claimed in claim 1, wherein said switching means comprises a voltage generator generating a fixed output voltage which is lower than said fixed range of said first control signal, said switching means comprising a vacuum reactive switch which is arranged in the intake passage and produces a detecting signal indicating whether the level of vacuum produced in the intake passage is smaller or greater than a predetermined level, said switching means being operated in response to the detecting signal of said vacuum reactive switch for feeding said second control signal into said drive pulse generator when the temperature of the engine is lower than said first predetermined temperature and when the level of said vacuum is greater than the predetermined level, said switching means feeding the output voltage of said voltage generator into said drive pulse generator when the temperature of the engine is lower than said first predetermined temperature and when the level of said vacuum is greater than the predetermined level.

35. An air-fuel ratio control device as claimed in claim 34, wherein said switching means comprises a first analog switch controlled by the detecting signal of said temperature reactive switch and passing said first control signal therethrough when the temperature of the engine is higher than said first predetermined temperature, said switch means comprising a second analog switch which is controlled by the detecting signal of said temperature reactive switch and the detecting signal of said vacuum reactive switch, and passes said second control signal therethrough when the level of said vacuum is greater than the predetermined level and when the temperature of the engine is lower than said first predetermined temperature, said switching means comprising a third analog switch which is controlled by the detecting signal of said vacuum reactive switch and the detecting signal of said temperature reactive switch, and passes the output voltage of said voltage generator therethrough when the level of said vacuum is smaller than the predetermined level and when the temperature of the engine is lower than said first predetermined temperature.

36. An air-fuel ratio control device as claimed in claim 35, wherein said vacuum reactive switch is turned to the ON condition when the level of said vacuum is greater than the predetermined level, said temperature reactive switch being turned to the ON condition when the temperature of the engine is lower than said first predetermined temperature, said switching means comprising a first AND gate which has a first input terminal and a second input terminal connected to said vacuum reactive switch, said first input terminal being connected to said temperature reactive switch, said switching means comprises a second AND gate which has a first input terminal and a second input terminal connected to said vacuum reactive switch, the first input terminal of said second AND gate being connected to said temperature reactive switch, said first analog switch being controlled by the detecting signal of said temperature reactive switch, said second analog switch and said third analog switch being controlled by output voltage of said first AND gate and said second AND gate, respectively.

37. An air-fuel ratio control device as claimed in claim 34, wherein the fixed output voltage of said voltage generator is equal to zero.

38. An air-fuel ratio control device as claimed in claim 1, wherein said switching means comprises: a voltage generator generating a fixed output voltage; an adder circuit for adding the output voltage of said voltage generator and the level of said second control signal; a vacuum reactive switch arranged in the intake passage and producing a detecting signal which indicates whether the level of vacuum produced in the intake passage is smaller or greater than a predetermined level, and; an atmospheric pressure reactive switch responsive to atmospheric pressure for producing a detecting signal indicating whether the atmospheric pressure is lower or higher than a predetermined level, said switching means being operated in response to the detecting signal of said vacuum reactive switch and the detecting signal of said atmospheric pressure reactive switch for feeding said second control signal into said drive pulse generator when the temperature of the engine is lower than said first predetermined temperature, and when the atmospheric pressure and the level of said vacuum are higher and greater than said corresponding predetermined levels, respectively, said switching means producing no output voltage when the temperature of the engine is lower than said first predetermined temperature, and when the atmospheric pressure and the level of said vacuum are higher and smaller than said corresponding predetermined levels, respectively, said switching means feeding the sum of said output voltage of said voltage generator and the level of said second control signal into said drive pulse generator when the temperature of the engine is lower than said first predetermined temperature, and when the atmospheric pressure and the level of said vacuum are lower and greater than said corresponding predetermined levels, respectively, said switching means feeding said second control signal into said drive pulse generator when the temperature of the engine is lower than said first predetermined temperature and when the atmospheric pressure and the level of said vacuum are lower and smaller than said corresponding predetermined levels, respectively.

39. An air-fuel ratio control device as claimed in claim 38, wherein said temperature reactive switch is turned to the ON condition when the temperature of the engine is lower than said first predetermined temperature, said vacuum reactive switch being turned to the ON condition when the level of said vacuum is greater than the predetermined level, said atmospheric pressure reactive switch being turned to the ON condition when the atmospheric pressure is lower than the predetermined level, said adder circuit having a first input terminal and a second input terminal, said switching means comprising: a first analog switch inserted between said detecting signal processing circuit and said drive pulse generator and controlled by the detecting signal of said temperature reactive switch for passing said first control signal therethrough when the temperature of the engine is higher than said first predetermined temperature; a second analog switch inserted between said adder circuit and said drive pulse generator and controlled by the detecting signal of said temperature reactive switch for feeding an output voltage of said adder circuit into said drive pulse generator when the temperature of the engine is lower than said first predetermined temperature; an AND gate having a first input terminal and a second input terminal which are connected to said vacuum reactive switch and said atmospheric pressure reactive switch, respectively; an OR gate having a first input terminal and a second input terminal which are connected to said vacuum reactive switch and said atmospheric pressure reactive switch, respectively; a third analog switch inserted between said voltage generator and the first input terminal of said adder circuit, and controlled by an output voltage of said AND gate for feeding the output voltage of said voltage generator into said adder circuit when the atmospheric pressure and the level of said vacuum are lower and greater than the corresponding predetermined levels, respectively, and; a fourth analog switch inserted between said control voltage generating means and the second input terminal of said adder circuit, and controlled by an output voltage of said OR gate for feeding said second control signal into said adder circuit when the atmospheric pressure and the level of said vacuum are not higher and smaller than the corresponding predetermined levels, respectively.

* * * * *